US008197047B2

(12) United States Patent
Wanibe

(10) Patent No.: US 8,197,047 B2
(45) Date of Patent: Jun. 12, 2012

(54) LIQUID CONTAINER

(75) Inventor: Akihisa Wanibe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 338 days.

(21) Appl. No.: 12/469,532

(22) Filed: May 20, 2009

(65) Prior Publication Data

US 2009/0295890 A1 Dec. 3, 2009

(30) Foreign Application Priority Data

May 27, 2008 (JP) ..... 2008-138561

(51) Int. Cl.
*B41J 2/19* (2006.01)

(52) U.S. Cl. ..... 347/92; 347/84; 347/85; 347/86; 347/93

(58) Field of Classification Search ..... None
See application file for complete search history.

(56) References Cited

U.S. PATENT DOCUMENTS

| | | | | |
|---|---|---|---|---|
| 6,520,632 | B1 * | 2/2003 | Yamazaki et al. | 347/92 |
| 7,419,253 | B2 | 9/2008 | Olsen et al. | |
| 2006/0187268 | A1 | 8/2006 | Olsen et al. | |
| 2006/0203053 | A1 | 9/2006 | Katsumura | |

FOREIGN PATENT DOCUMENTS

| | | | |
|---|---|---|---|
| JP | 2000-177144 | | 6/2000 |
| JP | 2004-276620 | | 10/2004 |
| JP | 2006-198845 | | 8/2006 |
| JP | 2006-248201 | A | 9/2006 |
| JP | 2008-044193 | | 2/2008 |
| JP | 2008-044195 | | 2/2008 |
| JP | 2008044193 | A * | 2/2008 |

OTHER PUBLICATIONS

Office Action for U.S. Appl. No. 12/473,786 dated Aug. 5, 2011.

* cited by examiner

*Primary Examiner* — Matthew Luu
*Assistant Examiner* — Erica Lin

(57) ABSTRACT

A liquid container mountable in a liquid ejecting apparatus. The liquid container includes a liquid storage section that stores liquid, an air communication section that allows the liquid storage section and an outside of the liquid container to communicate with each other, a bubble separation unit that separates bubbles from the liquid, a communication path that allows the bubble separation unit and the liquid storage section to communicate with each other and has at one end thereof an exit connected to the bubble separation unit and at the other end thereof an entrance connected to the liquid storage section, the exit having a cross section whose area continuously increases toward the bubble separation unit, a liquid supply unit through which the liquid is supplied to the liquid ejecting apparatus, and a detection unit that is connected to the liquid supply unit and the bubble separation unit and detects an amount of the liquid stored in the liquid container.

9 Claims, 14 Drawing Sheets

LIQUID CONTAINER

BACKGROUND

1. Technical Field

The present invention relates to liquid containers that store liquid to be supplied to liquid ejecting apparatuses.

2. Related Art

Examples of liquid containers to be mounted in liquid ejecting apparatuses include ink cartridges to be mounted in ink jet printers. In particular, ink cartridges having ink sensors that detect the amount of ink stored therein are practically in use. In general, an ink sensor detects whether or not ink is present in a sensor chamber communicating with an ink storage section. Specifically, the ink sensor detects the presence/absence of ink on the basis of physical properties of ink, or liquid, and air: for example, the difference in vibration frequency specific to a system including the sensor chamber. This leads to a problem that, if bubbles are contained in the ink in the sensor chamber, detection accuracy may be deteriorated. To solve this problem, JP-A-2008-44195 discloses an exemplary technique in which a bubble-trapping chamber and a maze-like flow path are provided between the sensor chamber and the ink storage section, whereby entry of bubbles into the sensor chamber is suppressed.

In the known technique, however, the bubble-trapping chamber and the ink storage section communicate with each other merely through the maze-like flow path. Therefore, other problems still remain: generation of bubbles when remaining ink is drawn from the ink storage section, and accumulation of bubbles moving from the maze-like flow path into the bubble-trapping chamber. These problems often occur particularly when there still remains a small amount of ink, and lead to misdetection of the amount of ink due to bubbles drawn into the sensor chamber.

The foregoing problems do not only apply to ink cartridges but are common to various liquid containers that are used for supplying liquid to liquid ejecting apparatuses, such as liquid containers that supply liquid materials containing metal to ejection apparatuses that eject the liquid materials onto semiconductors so as to form electrode layers.

SUMMARY

An advantage of some aspects of the invention is that it provides a liquid container having a detecting unit in which entry of bubbles into the detecting unit is suppressed or prevented.

To solve at least some of the problems described above, the invention takes various modes as described below.

According to an aspect of the invention, a liquid container mountable in a liquid ejecting apparatus is provided. The liquid container includes a liquid storage section that stores liquid, an air communication section that allows the liquid storage section and an outside of the liquid container to communicate with each other, a bubble separation unit that separates bubbles from the liquid, a communication path that allows the bubble separation unit and the liquid storage section to communicate with each other and has at one end thereof an exit connected to the bubble separation unit and at the other end thereof an entrance connected to the liquid storage section, the exit having a cross section whose area continuously increases toward the bubble separation unit, a liquid supply unit through which the liquid is supplied to the liquid ejecting apparatus, and a detection unit that is connected to the liquid supply unit and the bubble separation unit and detects an amount of the liquid stored in the liquid container.

The liquid container according to the above aspect has the communication path that has at one end thereof the exit connected to the bubble separation unit and at the other end thereof the entrance connected to the liquid storage section, the exit having a cross section whose area continuously increases toward the bubble separation unit. Therefore, in the liquid container having the detection unit, entry of bubbles into the detection unit can be suppressed or prevented.

In the liquid container according to the above aspect, the communication path may have a tubular shape with a radius r1, the exit may have a round corner with a curvature radius r2, and a condition of $r2 \geqq r1 \times 2$ may be satisfied. In such a case, the cross-sectional area of the exit can be made to continuously increase toward the bubble separation unit. Thus, generation of bubbles can be suppressed or prevented.

In the liquid container according to the above aspect, the exit may have a cone shape with a cone angle of 75 degrees at the maximum. In such a case, the cross-sectional area of the exit can be made to continuously increase toward the bubble separation unit. Thus, generation of bubbles can be suppressed or prevented.

In the liquid container according to the above aspect, the bubble separation unit may have a cross section whose area continuously increases from the exit toward the detection unit. In such a case, the bubble separation unit can enlarge the surface area of a liquid film, thereby promoting the elimination of the liquid film (a bubble).

In the liquid container according to the above aspect, the bubble separation unit may widen in a thickness direction of the liquid container from the exit toward the detection unit, the thickness direction intersecting a direction from the exit toward the detection unit. In such a case, the bubble separation unit can enlarge the surface area of a liquid film, thereby promoting the elimination of the liquid film (a bubble).

In the liquid container according to the above aspect, the entrance may have a larger cross section than the communication path. In such a case, when there is still a small amount of liquid remaining, drawing of the liquid into the communication path can be suppressed.

In the liquid container according to the above aspect, the entrance may have a cross section whose area increases toward the liquid storage section. In such a case, the flow of air into the communication path can be promoted. In addition, when there is still a small amount of liquid remaining, drawing of the liquid into the communication path can be suppressed.

In the liquid container according to the above aspect, the entrance may have a sector shape that widens, in a state where the liquid container is oriented so as to be mounted in the liquid ejecting apparatus, upward in a vertical direction. In such a case, the flow of air into the communication path can be promoted.

In the liquid container according to the above aspect, the bubble separation unit may have a larger capacity than the communication path. In such a case, the bubble separation unit can separate air from the liquid while receiving a mass of air equivalent to the capacity of the communication path.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will now be described with reference to the drawings. Hereafter in this specification, an ink cartridge will be taken as an example of a liquid container.

Configuration of Ink Cartridge

Figure 1:
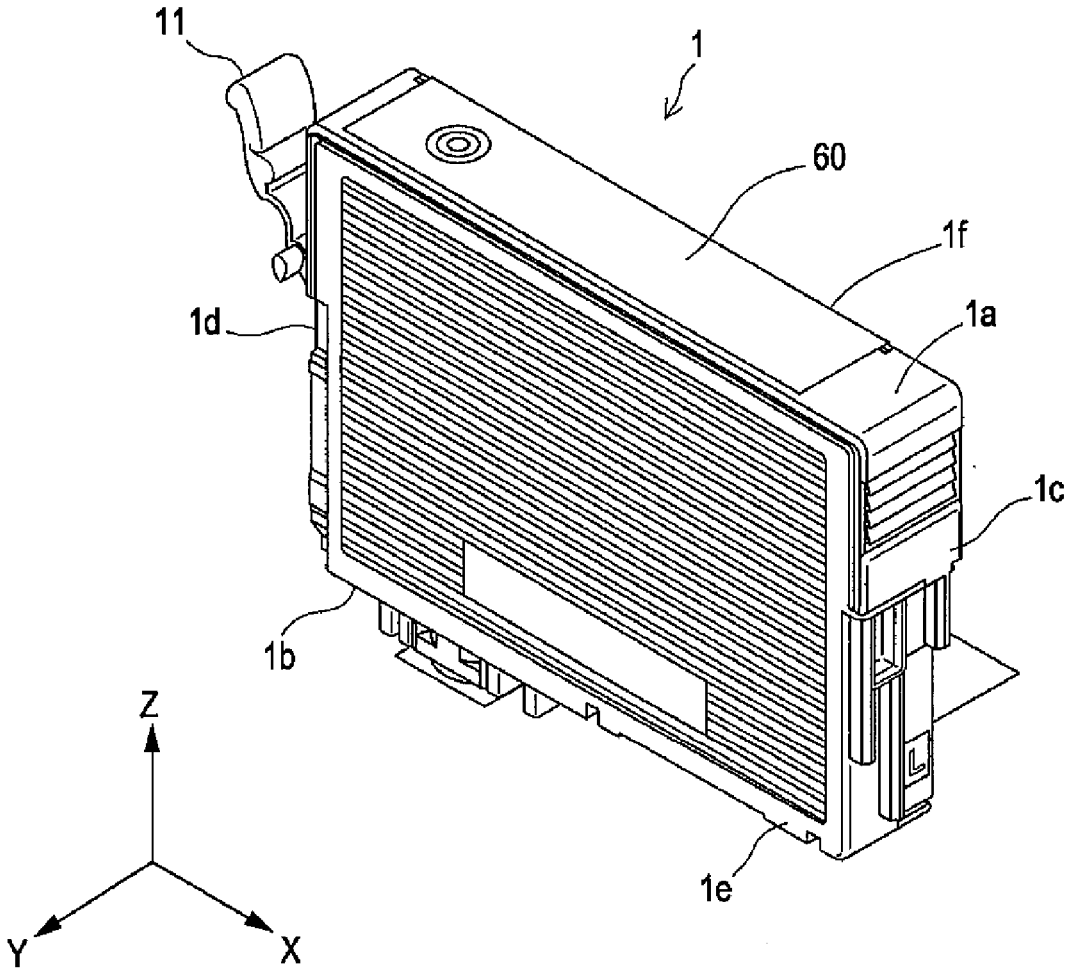
FIG. 1 is an external perspective view of an ink cartridge, as a liquid container, according to an embodiment of the invention.
Figure 2:
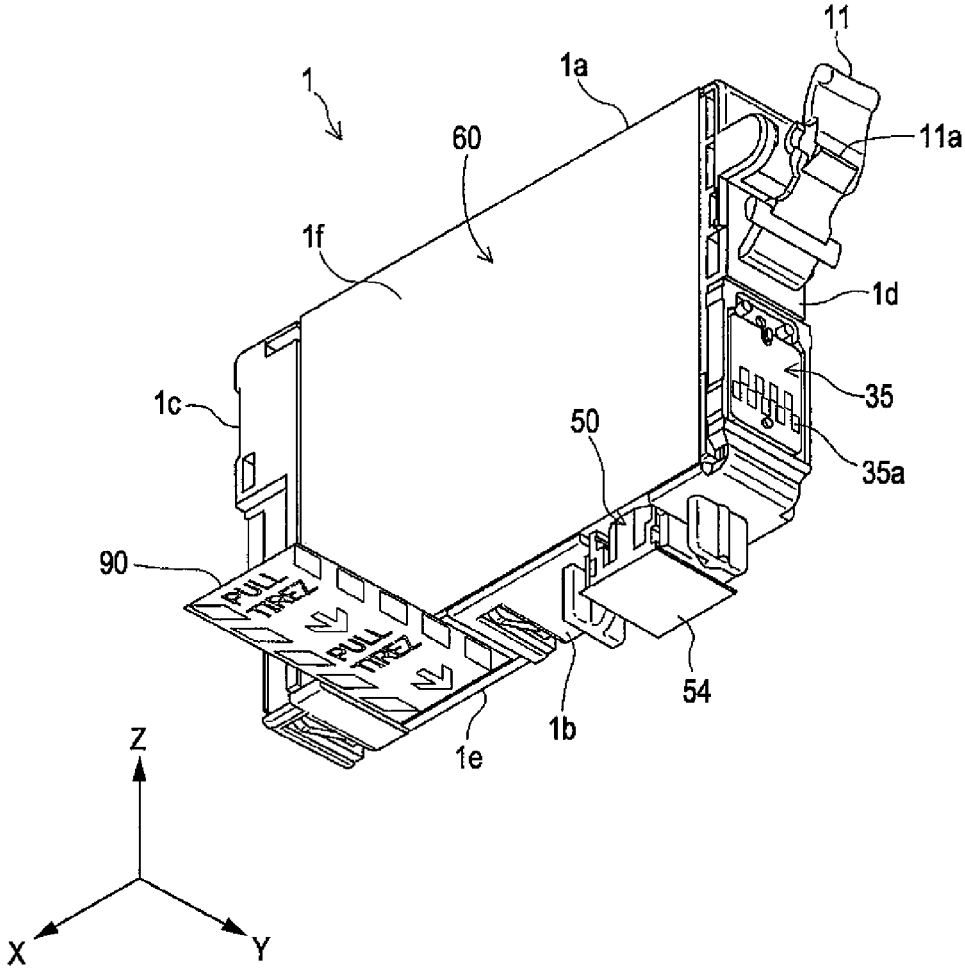
FIG. 2 is another external perspective view of the ink cartridge according to the embodiment seen from the back thereof.
Figure 3:
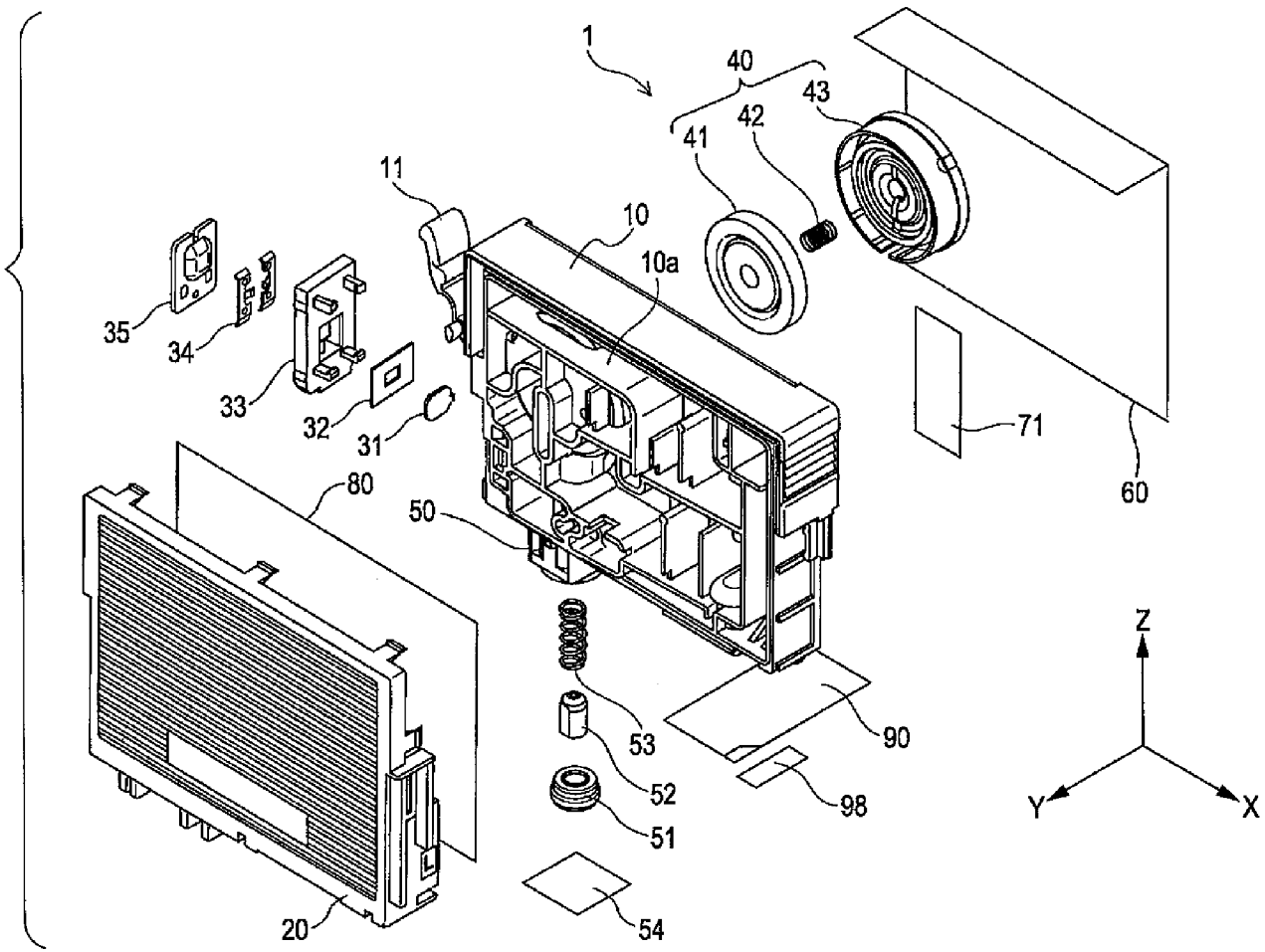
FIG. 3 is an exploded perspective view of the ink cartridge according to the embodiment, corresponding to FIG. 1.
Figure 4:
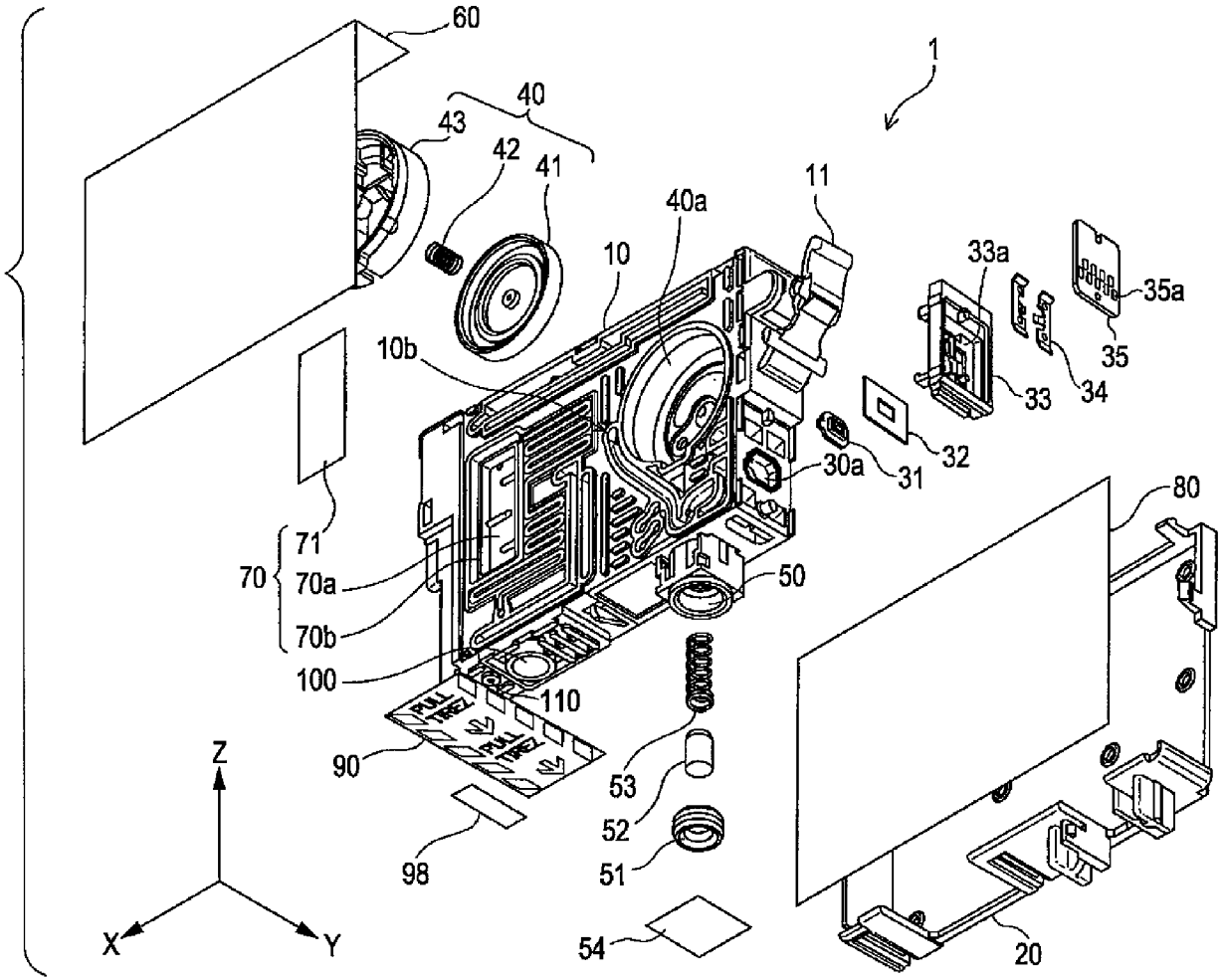
FIG. 4 is another exploded perspective view of the ink cartridge according to the embodiment, corresponding to FIG. 2.
Figure 5:
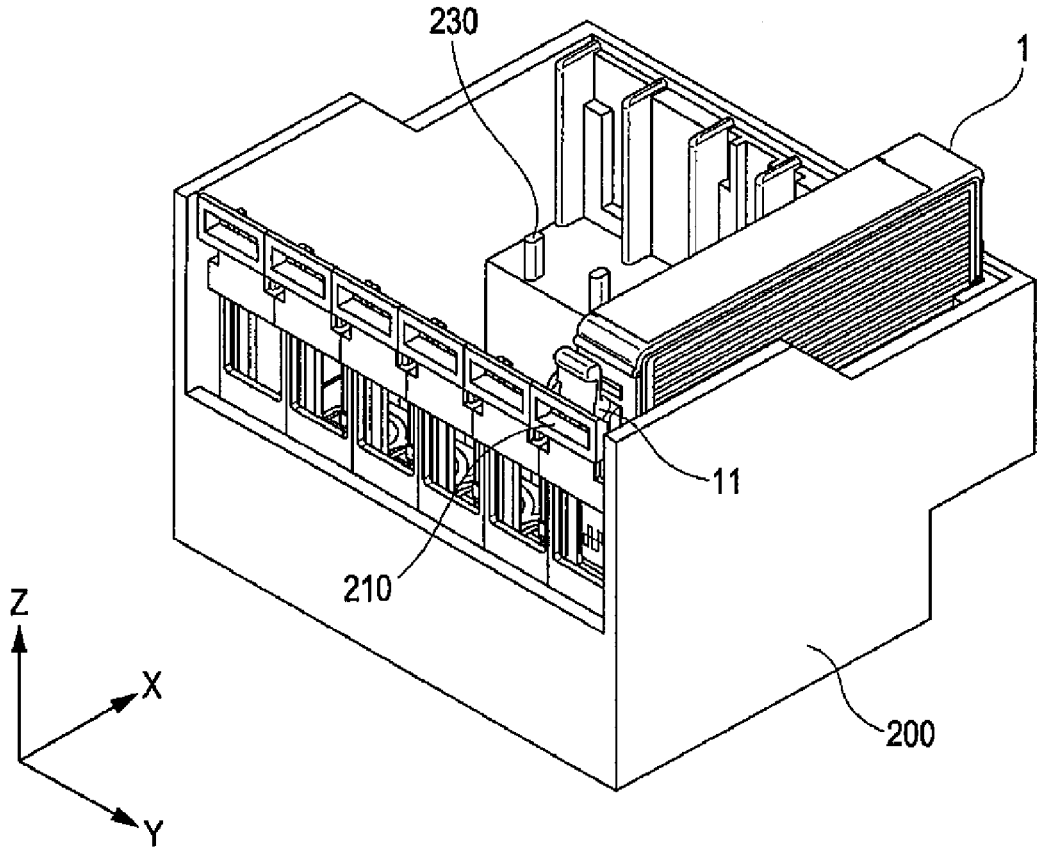
FIG. 5 shows a state where the ink cartridge according to the embodiment is mounted on a carriage.

FIG. 1 is an external perspective view of an ink cartridge, as a liquid container, according to an embodiment of the invention. FIG. 2 is another external perspective view of the ink cartridge according to the embodiment shown in FIG. 1, seen from the back thereof. FIG. 3 is an exploded perspective view of the ink cartridge according to the embodiment, corresponding to FIG. 1. FIG. 4 is another exploded perspective view of the ink cartridge according to the embodiment, corresponding to FIG. 2. FIG. 5 shows a state where the ink cartridge according to the embodiment is mounted on a carriage. In FIGS. 1 to 5, the X, Y, and Z axes are shown for easier recognition of the position (orientation) of the ink cartridge.

An ink cartridge 1 stores liquid ink thereinside. Referring to FIG. 5, the ink cartridge 1 is mounted on a carriage 200 of an ink jet printer, for example, and supplies the ink to the ink jet printer. Although FIG. 5 shows the ink cartridge 1 mounted on the carriage 200 (a so-called on-carriage type), the ink cartridge 1 may alternatively be mounted on a mount provided at a separate position from the carriage 200 (a so-called off-carriage type).

Referring to FIGS. 1 and 2, the ink cartridge 1 is substantially a rectangular parallelepiped and has a face 1*a* on the positive side in the Z-axis direction, a face 1*b* on the negative side in the Z-axis direction, a face 1*c* on the positive side in the X-axis direction, a face 1*d* on the negative side in the X-axis direction, a face 1*e* on the positive side in the Y-axis direction, and a face 1*f* on the negative side in the Y-axis direction. Hereinafter, for convenience of description, the faces 1*a*, 1*b*, 1*c*, 1*d*, 1*e*, and 1*f* are also referred to as a top face, a bottom face, a right side face, a left side face, a front face, and a back face, respectively. Further, the sides near the faces 1*a* to 1*f* are also referred to as an upper side, a lower side, a right side, a left side, a front side, and a back side, respectively.

Referring to FIG. 4, there are provided on the bottom face 1*b* a liquid supply unit 50 having a supply hole through which ink is supplied to the ink jet printer, and an air release hole 100 through which air is introduced into the ink cartridge 1.

The air release hole 100 has such a depth and a diameter that a projection 230 (refer to FIG. 5) provided on the carriage 200 of the ink jet printer can be fitted therein with a predetermined allowance. A user can mount the ink cartridge 1 onto the carriage 200 after removing a sealing film 90 that seals the air release hole 100 airtight. The projection 230 is intended to prevent the user's forgetting to remove the sealing film 90.

Referring to FIGS. 1 and 2, a locking lever 11 is provided on the left side face 1*d*. The locking lever 11 has a projection 11*a*. When the ink cartridge 1 is mounted onto the carriage 200, the projection 11*a* engages a recess 210 (refer to FIG. 5) provided in the carriage 200, whereby the ink cartridge 1 is fixed to the carriage 200. The carriage 200 serves as a mount on which the ink cartridge 1 is mounted. When the ink jet printer performs printing, the carriage 200 reciprocates together with a printhead (not shown) in a width direction of a print medium (a main scanning direction indicated by the Y-axis direction in FIG. 5).

Referring to FIG. 2, a circuit board 35 is provided below the locking lever 11 on the left side face 1*d*. The circuit board 35 has a plurality of electrode terminals 35*a*. The electrode terminals 35*a* are electrically connected to the ink jet printer via electrode terminals (not shown) provided on the carriage 200.

The top face 1*a* and the back face 1*f* of the ink cartridge 1 are covered with an outer surface film 60 pasted thereover.

Referring to FIGS. 3 and 4, the internal configuration of the ink cartridge 1 and the configurations of individual components will now be described. The ink cartridge 1 has a cartridge body 10 and a covering member 20 that covers the front side of the cartridge body 10.

Referring to FIG. 3, the cartridge body 10 has on the front side thereof ribs 10*a* having various shapes. A film 80 is interposed between the cartridge body 10 and the covering member 20 so as to cover the front side of the cartridge body 10. The film 80 is pasted on the front-side ends of the ribs 10*a* tightly with no gaps therebetween. The ribs 10*a* and the film 80 in combination constitute a plurality of small chambers, including an end chamber and a buffer chamber described below, sectioned in the ink cartridge 1.

Referring to FIG. 4, the cartridge body 10 has on the back side thereof a differential-pressure-valve-housing chamber 40*a* and an air-liquid separation chamber 70*a*. The differential-pressure-valve-housing chamber 40*a* houses a differential pressure valve 40 that includes a valve member 41, a spring 42, and a spring washer 43. The air-liquid separation chamber 70*a* has on the inner wall surrounding the bottom thereof a stepped portion 70*b*, on which an air-liquid separation film 71 is pasted. The air-liquid separation chamber 70*a*, the stepped portion 70*b*, and the air-liquid separation film 71 constitute an air-liquid separation filter 70.

Referring to FIG. 4, the cartridge body 10 also has on the back side thereof a plurality of grooves 10*b*. In a state where the outer surface film 60 is pasted substantially all over the back side of the cartridge body 10, the grooves 10*b* serve as various flow paths described below, such as flow paths through which ink and air flows, between the cartridge body 10 and the outer surface film 60.

The configuration around the circuit board 35 will now be described. Referring to FIG. 4, the cartridge body 10 has in a lower region on the left side thereof a sensor-housing chamber 30*a*. The sensor-housing chamber 30*a* houses a remaining-liquid-amount sensor 31, which is bonded thereto with a film 32. The sensor-housing chamber 30*a* has an opening on the left side. The opening is covered with a covering member 33. The covering member 33 secures on an outer surface 33*a* thereof the circuit board 35 with a junction terminal 34 interposed therebetween. A set of the sensor-housing chamber 30*a*, the remaining-liquid-amount sensor 31, the film 32, the covering member 33, the junction terminal 34, and the circuit board 35 is also referred to as a detection (sensor) unit 30.

Although details are not shown, the remaining-liquid-amount sensor 31 includes a cavity constituting a part of an ink flow path section, which will be described below, a vibrating plate constituting a part of walls of the cavity, and a piezoelectric element provided on the vibrating plate. A terminal of the piezoelectric element is electrically connected to any of the electrode terminals 35*a* on the circuit board 35. In the state where the ink cartridge 1 is mounted in the ink jet printer, the terminal of the piezoelectric element is electrically connected to the ink jet printer via the electrode terminal 35*a* of the circuit board 35. When electric energy is fed from the ink jet printer to the piezoelectric element, the vibrating plate can be vibrated by the piezoelectric element. Thus, the ink jet printer can detect the presence/absence of ink in the cavity by detecting through the piezoelectric element a characteristic (the frequency, for example) of residual vibration in the vibrating plate. Specifically, detection is performed by utilizing variations in the vibration frequency of the vibrating plate (the frequency of a detection signal) between a case where ink is present in the cavity and a case where ink is absent in the cavity. When all of the ink stored in the cartridge body 10 is consumed, the interior of the cavity that has been filled with the ink becomes filled with air. This changes the characteristic of the residual vibration in the vibrating plate. Such a change in the vibration characteristic is detected by the remaining-liquid-amount sensor 31. Thus, the ink jet printer can detect the presence/absence of ink in the cavity, that is, whether or not ink remains in the ink cartridge 1.

The circuit board 35 is provided with a rewritable nonvolatile memory, such as an electronically erasable and programmable read-only memory (EEPROM), in which the amount of ink remaining in or consumed from the ink cartridge 1, the type of ink, the date of manufacture, and so forth are stored.

Referring to FIG. 4, the cartridge body 10 has on the bottom thereof a depressurization hole 110, in addition to the liquid supply unit 50 and the air release hole 100 described above. The depressurization hole 110 is used for reducing the pressure inside the ink cartridge 1 by means of vacuuming when ink is injected thereinto in a process of manufacturing the ink cartridge 1.

At the completion of manufacture of the ink cartridge 1, the liquid supply unit 50, the air release hole 100, and the depressurization hole 110 are sealed with a sealing film 54, the sealing film 90, and a sealing film 98, respectively. As mentioned above, the sealing film 90 is removed by the user before the ink cartridge 1 is mounted on the carriage 200 of the ink jet printer, whereby the air release hole 100 is exposed to the outside, and air is introduced into the ink cartridge 1. The sealing film 54 is broken by an ink supply needle 240 (refer to FIG. 6) provided on the carriage 200 when the ink cartridge 1 is mounted onto the carriage 200 of the ink jet printer.

The liquid supply unit 50 houses, in order from the bottom, a sealing member 51, a spring washer 52, and a closure spring 53. In a state where the ink supply needle 240 is placed inside the liquid supply unit 50, the sealing member 51 seals between the inner wall of the liquid supply unit 50 and the outer wall of the ink supply needle 240 so as not to allow a gap therebetween. In a state where the ink cartridge 1 is not mounted on the carriage 200, the spring washer 52 is in contact with the inner wall of the sealing member 51, thereby closing the liquid supply unit 50. The closure spring 53 urges the spring washer 52 in such a direction that the spring washer 52 comes into contact with the inner wall of the sealing member 51. When the ink supply needle 240 of the carriage 200 is introduced into the liquid supply unit 50, the tip of the ink supply needle 240 pushes up the spring washer 52, whereby a gap is produced between the spring washer 52 and the sealing member 51. Ink is supplied through this gap to the ink supply needle 240.

Figure 6:
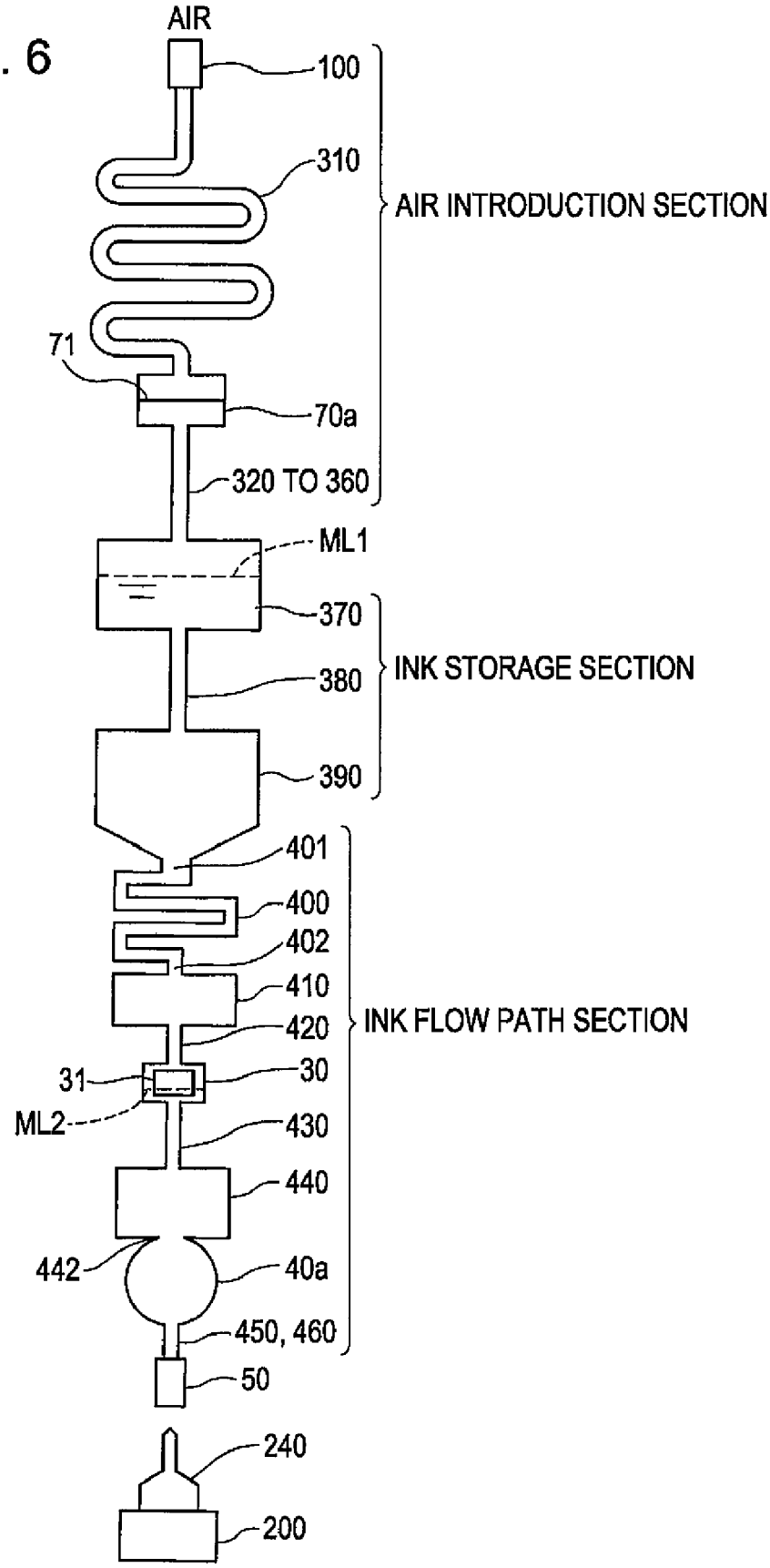
FIG. 6 is a conceptual diagram of a path extending from an air release hole to a liquid supply unit of the ink cartridge according to the embodiment.

Before providing further details about the internal configuration of the ink cartridge 1, for easier understanding thereof, a path extending from the air release hole 100 to the liquid supply unit 50 will now be described conceptually with reference to FIG. 6. FIG. 6 is a conceptual diagram of the path extending from the air release hole 100 to the liquid supply unit 50.

The path from the air release hole 100 to the liquid supply unit 50 is roughly divided into the following: an ink storage section in which ink is stored, an air introduction section (air communication section) provided on the upstream side with respect to the ink storage section, and the ink flow path section provided on the downstream side with respect to the ink storage section.

The ink storage section includes, in order from the upstream side, a tank chamber 370 serving as a first liquid-storage chamber, an inter-chamber communication path 380, and an end chamber 390 serving as a second liquid-storage chamber. The tank chamber 370 and the end chamber 390, or the first and second liquid-storage chambers, are not necessarily provided separately, and may be integrated into a single liquid-storage chamber. Alternatively, three or more liquid-storage chambers may be provided. In general, by providing separate liquid-storage chambers, the influence of changes in the volume of the air contained in the storage chambers occurring because of changes in ambient temperature or the like can be suppressed (or shared therebetween). The inter-chamber communication path 380 communicates at the upstream end thereof with the tank chamber 370, and at the downstream end thereof with the end chamber 390.

The air introduction section includes, in order from the upstream side, a meandering path 310, the air-liquid separation chamber 70*a* in which the air-liquid separation film 71 is provided, and a first to fifth air chambers 320 to 360 through which the air-liquid separation chamber 70*a* and the ink storage section are connected to each other. The air introduction section serves as an air communication section that allows the outside of the ink cartridge 1 and the ink storage section to communicate with each other. The meandering path 310 communicates at the upstream end thereof with the outside through the air release hole 100, and at the downstream end thereof with the air-liquid separation chamber 70*a*. The meandering path 310 has a narrow, meandering shape so that the distance from the air release hole 100 to the first liquid-storage chamber becomes long. In this manner, evaporation of moisture contained in the ink stored in the ink storage section can be suppressed. The air-liquid separation film 71 is made of a material that allows air passage but blocks liquid. With the air-liquid separation film 71 sectioning the air-liquid separation chamber 70*a* into the upstream portion and the downstream portion, ink flowing backward from the ink storage section can be prevented from flowing upstream beyond the air-liquid separation chamber 70*a*. The specific configuration of the air chambers 320 to 360 will be described separately below.

The ink flow path section includes, in order from the upstream side, a vertical communication path 400 (corresponding to a communication path), a bubble separation chamber 410, a first flow path 420, the sensor unit 30, a second flow path 430, a buffer chamber 440, the differential-pressure-valve-housing chamber 40*a* that houses the differential pressure valve 40, a third flow path 450, and a fourth flow path 460.

Figure 7:
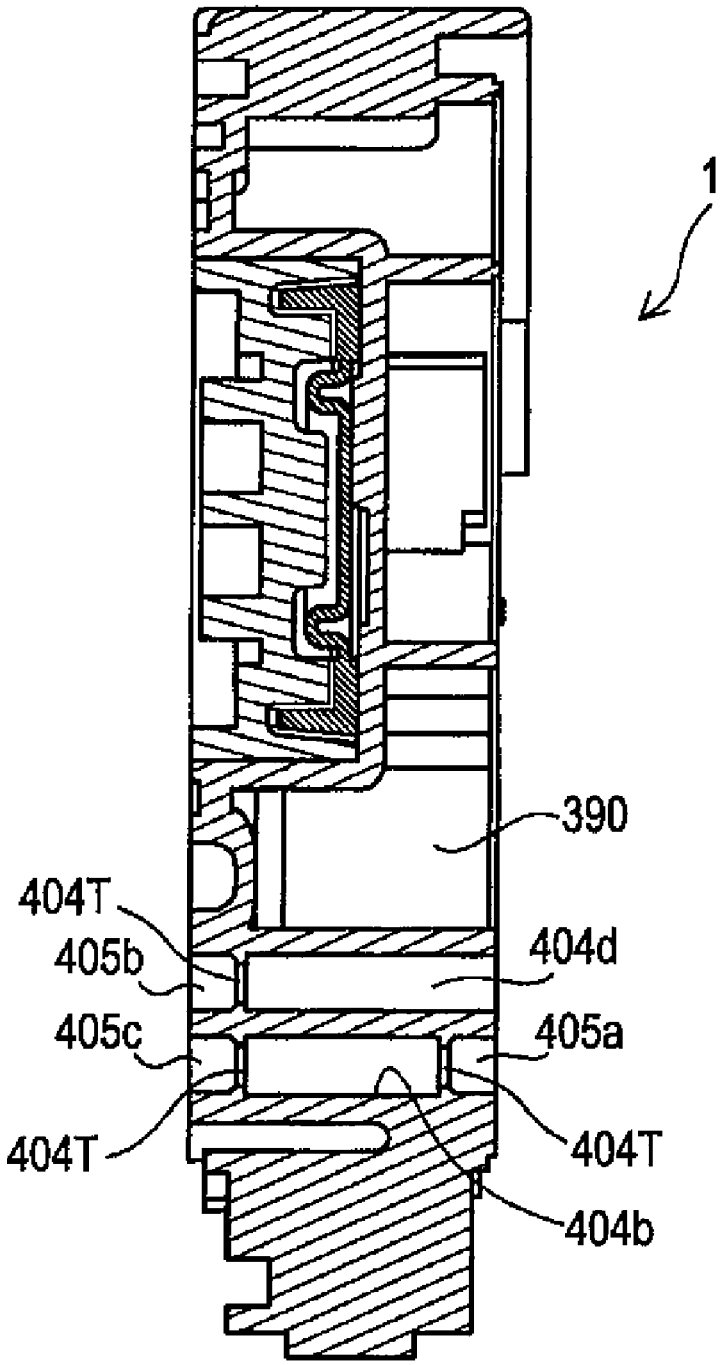
FIG. 7 is a cross-sectional view of the ink cartridge, taken along the line VII-VII in FIG. 15.
Figure 8:
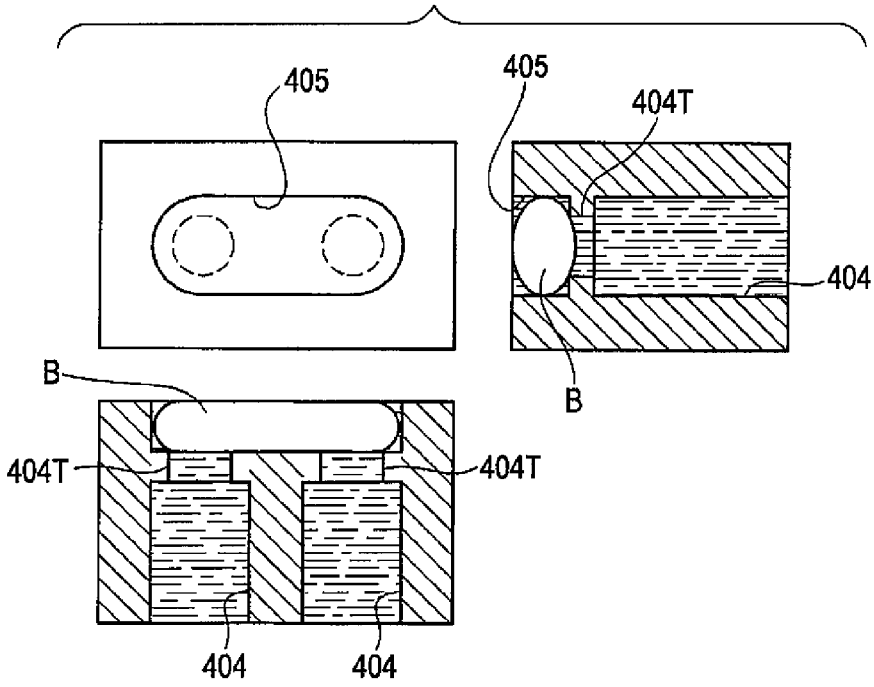
FIG. 8 is a diagram for describing some features of a vertical communication path according to the embodiment.
Figure 9:
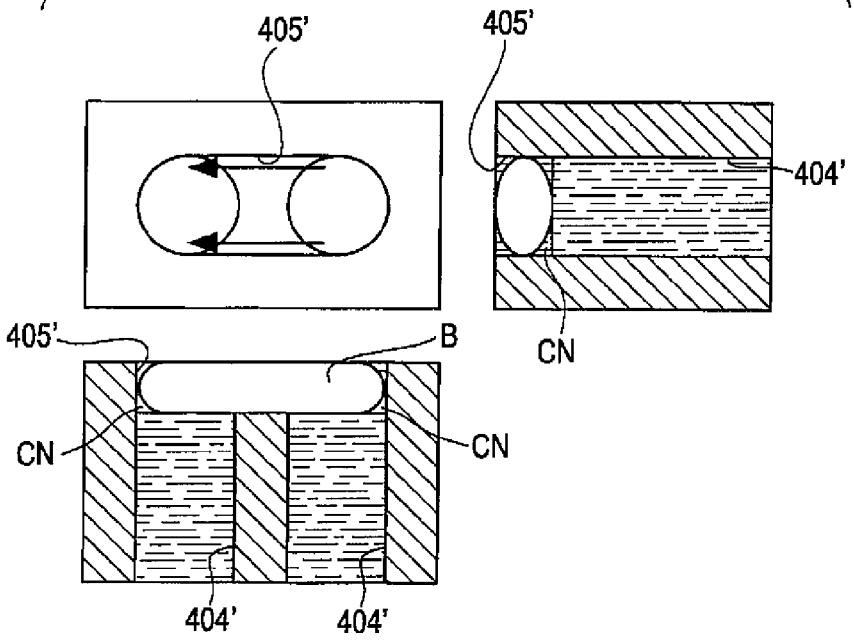
FIG. 9 shows a comparative example for describing the features of the vertical communication path according to the embodiment.
Figure 10:
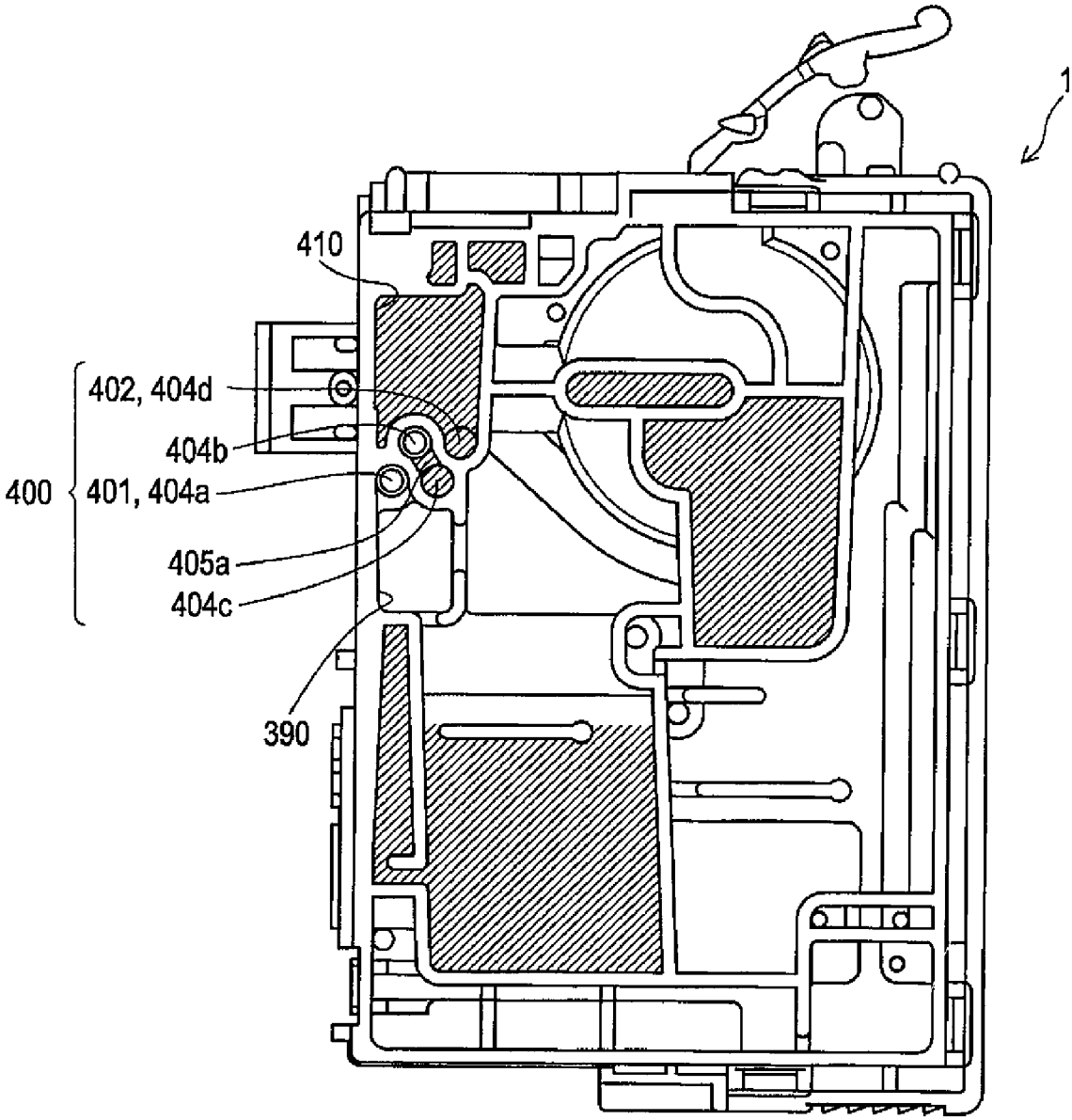
FIG. 10 is a diagram for describing the features of the vertical communication path in relation to the orientation of the ink cartridge according to the embodiment.

The vertical communication path 400 includes a plurality of bends, forming a three-dimensional structure having a rectangular back-and-forth shape. Details of the vertical communication path 400 will now be described with reference to FIGS. 7 to 10. FIG. 7 is a cross-sectional view of the ink cartridge 1, taken along the line VII-VII in FIG. 15, which will be described separately below. FIG. 8 is a diagram for describing some features of the vertical communication path 400 according to the embodiment. FIG. 9 shows a comparative example for describing the features of the vertical communication path 400 according to the embodiment. FIG. 10 is a diagram for describing the features of the vertical communication path 400 in relation to the orientation of the ink cartridge 1 according to the embodiment.

Figure 11:
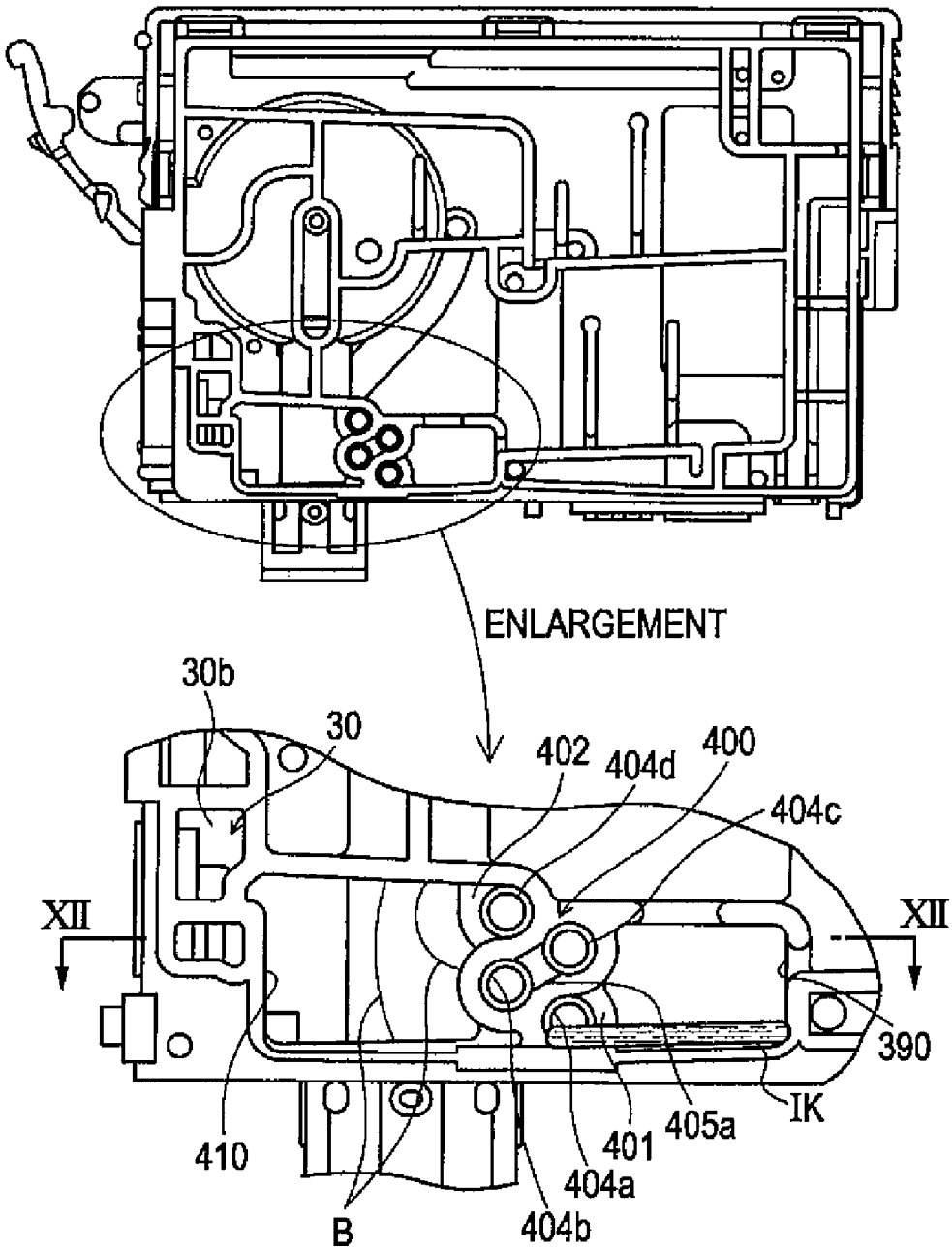
FIG. 11 is an enlarged view of the connection between the vertical communication path and a bubble separation chamber.

The vertical communication path 400 includes first to fourth cylindrical segments 404*a* to 404*d* and first to third connecting segments 405*a* to 405*c*. Referring to FIGS. 8 and 11, the cylindrical segments 404*a* to 404*d* each extend in a direction intersecting the vertical direction and are arranged so as to be staggered with respect to the vertical direction. Specifically, the cylindrical segments 404*a* to 404*d* each extend parallel to the bottom face 1*b* of the ink cartridge 1 across the thickness (the Y direction) of the ink cartridge 1, and are positioned at respectively different levels in the vertical direction (the height direction). In the embodiment, the cylindrical segments 404*a* to 404*d* are divided into two groups, each including two cylindrical segments overlapping in the vertical direction: a group of the first and third cylindrical segments 404*a* and 404*c*, and a group of the second and fourth cylindrical segments 404*b* and 404*d*. The vertical levels at which the cylindrical segments 404*a* to 404*d* are positioned become higher in order from the first cylindrical segment 404*a* to the fourth cylindrical segment 404*d*.

The connecting segments 405 (405*a* to 405*c*), which are provided on the front and back sides of the ink cartridge 1, each extend obliquely upward and connect two of the cylindrical segments 404 (404*a* to 404*d*), whereby a single communication path extending from an entrance 401 to an exit 402, i.e., the vertical communication path 400, is provided. On the side where two of the connecting segments 405 are provided, the two connecting segments 405 extend parallel to each other, with each connecting segment 405 connecting two cylindrical segments 404 to each other. Specifically, on the front side shown in FIG. 11, one end of the second cylindrical segment 404*b* and one end of the third cylindrical segment 404*c* are connected to each other with the first connecting segment 405*a*. Further, on the back side shown in FIG. 16, one end of the first cylindrical segment 404*a* and the other end of the second cylindrical segment 404*b* are connected to each other with the second connecting segment 405*b*, and the other end of the third cylindrical segment 404*c* and one end of the fourth cylindrical segment 404*d* are connected to each other with the third connecting segment 405*c*. Thus, the vertical communication path 400 having a rectangular back-and-forth (or spiral) shape and rising in the vertical direction from the entrance 401 to the exit 402 is provided. The first to third connecting segments 405*a* to 405*c* can serve as communication paths only when the outer surface film 60 and the film 80 are pasted thereover. In this respect, the first to third connecting segments 405*a* to 405*c* can also be referred to as first to third connecting-segment-forming portions. The first to third connecting segments 405*a* to 405*c* each desirably have a cross section without sharp edges, i.e., a semicircular or round cross section. If the connecting segments 405*a* to 405*c* have a sharp-edged cross section, there may be a gap between the edge and a curved surface of a bubble, making it difficult to seal in the ink.

The vertical communication path 400 having such a shape can reduce the probability that bubbles generated because of changes in outside environment, such as outside temperature or pressure, may enter the bubble separation chamber 410. A typical example is as follows. When the outside temperature drops and ink that fills the bubble separation chamber becomes frozen, the volume of the ink increases, and the frozen ink moves toward the end chamber. When the frozen ink melts, the volume of the ink returns to its original value, or is reduced. Depending on the orientation of the ink cartridge, when the frozen ink starts to melt, the entrance of the bubble separation chamber may touch a mass of air in the end chamber. If the melting of the frozen ink progresses in such a state, the air in the end chamber may flow into the bubble separation chamber, causing a problem of generation of bubbles in the bubble separation chamber. In the embodiment, to solve such a problem, the capacity of the vertical communication path 400 is set to be larger than the freezing-induced increment in the volume of ink that, in the unfrozen state, fills a range from the bubble separation chamber 410 to the buffer chamber 440. Thus, the ink that has frozen is kept within the vertical communication path 400 even after it melts. Consequently, entry of air (bubbles) into the bubble separation chamber 410 is suppressed or prevented.

Referring to FIGS. 7 and 8, the cylindrical segments 404 according to the embodiment include, at ends thereof connected to the connecting segments 405, narrow portions 404T having smaller diameters than the other portions of the cylindrical segments 404 and the connecting segments 405. Thus, the flow of ink from the connecting segments 405 to the cylindrical segments 404 is prevented or suppressed. The diameters of the other portions of the cylindrical segments 404 and the diameters of the connecting segments 405 may be the same. Alternatively, the diameters of the other portions of the cylindrical segments 404 may be larger or smaller than the diameters of the connecting segments 405.

Referring to FIG. 9, in a case of cylindrical segments 404' not including narrow portions, even if there is a bubble B in a connecting segment 405', the cylindrical segments 404' and the connecting segment 405' communicate with each other through a gap CN produced between the curved surface of the bubble B and the wall of the connecting segment 405'. This means that ink can flow between the end chamber 390 and the bubble separation chamber 410 through the gap CN. Therefore, when a pressure is applied to the ink from the downstream side (the side of the bubble separation chamber 410), the ink flows out toward the end chamber 390. Meanwhile, the bubble B stays in the connecting segment 405' because the ink can flow through the gap CN. Moreover, the bubble B is combined with other bubbles B coming from the upstream side, resulting in more bubbles B on the downstream side. Thus, bubbles often gather in such a vertical communication path.

In contrast, referring to FIG. 8 showing the case where the cylindrical segments 404 include the narrow portions 404T, since the narrow portions 404T have smaller diameters than the other portions of the cylindrical segments 404 and the connecting segments 405, a bubble B that has entered the connecting segment 405 has a larger diameter than the narrow portions 404T of the cylindrical segments 404. Therefore, the narrow portion 404T prevents the gap between the curved surface of the bubble B and the wall of the connecting segment 405 from communicating with the cylindrical segments 404, producing a state where the cylindrical segments 404 are sealed by the bubble B. That is, the bubble B that has entered the connecting segment 405 is pushed by the pressure applied thereto from the downstream side toward the cylindrical segment 404 on the upstream side, whereby the cylindrical segment 404 (the narrow portion 404T) is sealed by the bubble B. As a result, the ink cannot flow between the end chamber 390 and the bubble separation chamber 410. Thus, the flow of the ink into the end chamber 390 can be suppressed or prevented.

Further, referring to FIG. 10, the vertical communication path 400 has a configuration in which, even when the ink cartridge 1 is not oriented so as to be mounted in the ink jet printer, that is, when the ink cartridge 1 is not oriented such that the bottom face 1*b* thereof faces down, bubbles cannot move toward the bubble separation chamber 410 unless the bubbles move in the direction of gravity.

Specifically, when the ink cartridge 1 is oriented as in FIG. 10, the first connecting segment 405*a* and the third connecting segment 405*c* in combination form a V-shape. That is, the connecting segments 405 include at least a connecting segment A extending obliquely downward (in a first direction) from the bubble separation chamber 410 with respect to the vertical direction and a connecting segment B connected to the connecting segment A through a cylindrical segment and extending obliquely downward (in a second direction) in an axisymmetrical manner with respect to the connecting segment A.

With the vertical communication path 400 having such a configuration, movement (flow) of bubbles into the bubble separation chamber 410 can be suppressed or prevented, regardless of the orientation of the ink cartridge 1 that has been removed from the ink jet printer. More specifically, when the ink cartridge 1 is oriented so as to be mounted in the ink jet printer, the entrance 401 of the vertical communication path 400 resides at the bottommost position of the end chamber 390 and is not exposed to air; in fact, bubbles do not move inside the vertical communication path 400. Even when the ink cartridge 1 is oriented in any other way, bubbles cannot move toward the bubble separation chamber 410 unless the bubbles move in the direction of gravity. Accordingly, movement of the bubbles can be suppressed or prevented. Thus, regardless of the orientation of the ink cartridge 1 when stored, movement of bubbles from the vertical communication path 400 to the bubble separation chamber 410 can be suppressed or prevented.

The bubble separation chamber 410 communicates with the first flow path 420 through a communication hole 412 (refer to FIG. 15) provided in the wall of the bubble separation chamber 410. The first flow path 420 communicates at the downstream end thereof with the sensor unit 30. The bubble separation chamber 410 separates bubbles from ink that has flowed therein from the vertical communication path 400, thereby suppressing or preventing movement of bubbles into the sensor unit 30. Specifically, with the exit 402 of the vertical communication path 400 provided at an upper position (in the Z direction) and the first flow path 420 connected at a lower position of the bubble separation chamber 410, the bubble separation chamber 410 introduces ink from the exit 402 and sends the ink through the first flow path 420 to the sensor unit 30. With such a configuration, the ink containing bubbles and flowing from the vertical communication path 400 into the bubble separation chamber 410 is separated into a gas component, i.e., the air contained in the ink, which is trapped in the upper portion of the bubble separation chamber 410, and a liquid component, i.e., the ink, which runs down the inner wall of the bubble separation chamber 410 to the lower portion of the bubble separation chamber 410. In short, according to the difference in specific gravity between gas and liquid, bubbles are trapped in the upper portion of the bubble separation chamber 410. If either air or ink is eliminated, no bubbles are generated. Therefore, by separating air and ink, a problem of misdetection by the remaining-liquid-amount sensor 31 due to entry of bubbles into the sensor unit 30 can be suppressed or prevented. Possible misdetections are as follows. In one case, although some ink still remains in the ink cartridge 1, ink shortage may be detected because of bubbles that have entered the sensor unit 30. In another case, although there is substantially no ink in the ink cartridge 1, the presence of ink may be detected because a slight amount of ink barely remaining therein is drawn together with air into the sensor unit 30, as a liquid containing bubbles, by capillary action. In the former case, although there is still some ink, printing cannot be performed. In the latter case, although there is no ink, printing is performed and the printhead may be damaged.

Figure 12:
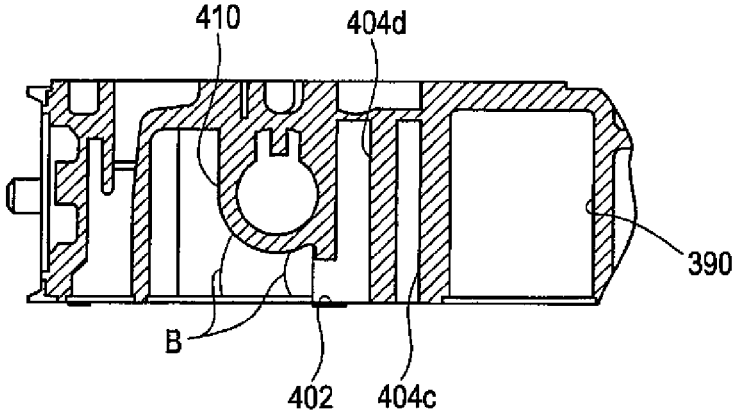
FIG. 12 is a cross-sectional view taken along the line XII-XII in FIG. 11.
Figure 13:
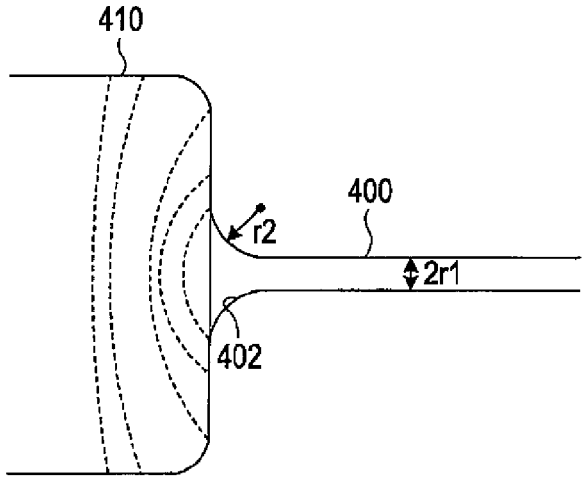
FIG. 13 is a schematic diagram showing the shape of the connection between the vertical communication path and the bubble separation chamber according to the embodiment.
Figure 14:
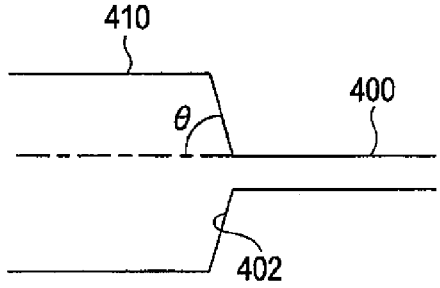
FIG. 14 is another schematic diagram showing the shape of the connection between the vertical communication path and the bubble separation chamber according to the embodiment.

Details about the connection between the vertical communication path 400 and the bubble separation chamber 410 will now be described with reference to FIGS. 11 to 14. FIG. 11 is an enlarged view of the connection between the vertical communication path 400 and the bubble separation chamber 410. FIG. 12 is a cross-sectional view taken along the line XII-XII in FIG. 11. FIG. 13 is a schematic diagram showing the shape of the connection between the vertical communication path 400 and the bubble separation chamber 410 according to the embodiment. FIG. 14 is another schematic diagram showing the shape of the connection between the vertical communication path 400 and the bubble separation chamber 410 according to the embodiment.

When the ink cartridge 1 is seen from the front side as in FIG. 11, the exit 402 of the vertical communication path 400 according to the embodiment has a sector shape smoothly widening toward the bubble separation chamber 410. Specifically, the exit 402 has a shape in which the area of the cross section intersecting a flow direction changes continuously (not in a stepwise manner) toward the bubble separation chamber 410. In FIG. 11, the exit 402 widens downward in the vertical direction. Alternatively, the exit 402 may widen upward or both upward and downward. In either case, the exit 402 only needs to widen with the foregoing cross section thereof changing in any manner but in a stepwise manner so that the exit 402 can be prevented from functioning as a nozzle.

In the embodiment, referring to FIG. 12, the area of the cross section, intersecting the flow direction, of the bubble separation chamber 410 also changes, or increases, continuously toward the sensor unit 30. That is, the bubble separation chamber 410 is configured such-that the width thereof in the thickness direction of the ink cartridge 1 increases continuously (not in a stepwise manner) toward the sensor unit 30, with a smoothly curved inner wall.

By providing the exit 402 of the vertical communication path 400 and the bubble separation chamber 410 with such smoothly widening (curved) shapes, generation of small bubbles can be suppressed, and any large bubbles B can be eliminated (broken). This is because of the following reason. When liquid, which has cohesive force, is pushed by air out of a narrow path having a small cross section to a wide (large) chamber having a large cross section, the liquid tends to form a sphere (a bubble) so as to maintain its small surface area. In general, when liquid is pushed out of a narrow path to a large chamber, the liquid in a film-like form (a liquid film) flowing in the path forms a bubble at a position where the cross-sectional area of the path sharply increases, for example, at a corner that could function as a nozzle. If such liquid films are successively pushed by air, a plurality of bubbles may be formed. In this case, since the cross section of the narrow path is far smaller than that of the large chamber, the bubbles that may be formed will have small diameters.

In the embodiment, the cross-sectional area at a position where the ink is pushed out of a narrow path to a large chamber changes gently (smoothly). Therefore, the ink is maintained in the film-like form. Specifically, by eliminating regions forming corners, generation of bubbles is suppressed or prevented. The larger the surface area of a liquid film becomes, the more easily the liquid film breaks. Therefore, most of ink films that are pushed out of the exit 402 to the bubble separation chamber 410 disappear while they are moving. Thus, the number of bubbles that may be generated in the bubble separation chamber 410 can be reduced, or generation of bubbles can be prevented. In the embodiment, since the inner wall of the bubble separation chamber 410 is also smoothly curved (the change in cross-sectional area is gentle) as shown in FIG. 11, generation of bubbles in the bubble separation chamber 410 is suppressed or prevented more. Further, since the bubble separation chamber 410 is configured such that the cross-sectional area thereof increases toward the sensor unit 30, the surface area of an ink film formed when ink is pushed out of the exit 402 is enlarged, whereby bubbles can be broken more easily. Referring to FIG. 11, small groves and recesses between the exit 402 and the bubble separation chamber 410 and small surface irregularities in the bubble separation chamber 410 are filled with ink, forming a smooth surface. Therefore, there are no sharp changes in cross-sectional area.

In a case shown in FIG. 13, for example, it is desirable that the relationship between the radius r1 of the vertical communication path 400 and the curvature radius r2 at the round corner of the exit 402 be expressed as $2*r1 \leqq r2$. If this condition is satisfied, the exit 402 does not function as a nozzle, and therefore generation of bubbles occurring when ink is pushed out of the exit 402 to the bubble separation chamber 410 can be prevented or suppressed. In another case shown in FIG. 14, where the exit 402 widens linearly, that is, the exit 402 has a cone shape, if the cone angle θ satisfies a condition of $\theta \leqq 75$ degrees, the exit 402 does not function as a nozzle, and therefore generation of bubbles occurring when ink is pushed out of the exit 402 to the bubble separation chamber 410 can be prevented or suppressed. In FIGS. 13 and 14, the exit 402 and the main portion of the vertical communication path 400 are shown in series with each other (along a particular line). Needles to say, as in FIGS. 10, 11, and others, the exit 402 may be oriented in a direction intersecting the direction of flow in the main portion of the vertical communication path 400.

Since the bubble separation chamber 410 has larger capacity than the vertical communication path 400, the bubble separation chamber 410 can sufficiently separate ink and air while receiving a mass of air equivalent to the capacity of the vertical communication path 400. Further, the bubble separation chamber 410 has a larger capacity than a sensor buffer chamber 30*b*, the ink remaining in the bubble separation chamber 410, not bubbles contained therein, is first drawn into the sensor buffer chamber 30*b*. That is, by designing the bubble separation chamber 410 to have a larger capacity than the sensor buffer chamber 30*b*, entry of bubbles into the sensor unit 30 can be suppressed.

Further, in the embodiment, the entrance 401 has a larger cross section intersecting the flow direction than the vertical communication path 400. In general, when the amount of remaining ink is small, the ink gathers at the bottom of the ink storage section. With the consumption of the ink, the ink is introduced together with air into the bubble separation chamber. Considering that bubbles (liquid films) are generated with the presence of ink and air, it is undesirable that ink be introduced together with air from the ink storage section into the bubble separation chamber. However, in the embodiment, the entrance 401 widens upward in the vertical direction as in FIG. 11. Therefore, even if ink IK is gathered at the bottom of the end chamber 390, the vertical communication path 400 is not closed by the ink IK, and only air flows into the vertical communication path 400 toward the bubble separation chamber 410. In short, when the flow of air is allowed, only air flows through the vertical communication path 400 into the bubble separation chamber 410, but the ink remains still. Consequently, bubbles are not generated often or at all. Thus, in a state where there is still a little ink remaining, entry of bubbles into the bubble separation chamber 410 can be suppressed or prevented. The entrance 401 may have any shape that allows the flow of air in a state where ink is gathered at the bottom of the end chamber 390. It is only necessary that the entrance 401 is angled upward with respect to a line parallel to the bottom of the end chamber 390. Drawing of remaining ink into the vertical communication path 400 becomes problematic when there is still a little ink remaining. That is, in a state where there is a sufficient amount of ink or substantially no ink remaining in the end chamber 390, the ink or air is solely drawn continuously into the vertical communication path 400. In the known-art example, in a state where there is such a little amount of ink that the entrance of the vertical communication path is barely below the ink surface, the ink surface moves with the flow of air. Therefore, ink and air may be drawn alternately into the vertical communication path. In such a case, small bubbles are generated successively.

The second flow path 430 communicates at the upstream end thereof with the sensor unit 30, and at the downstream end thereof with the buffer chamber 440. A stirring ball may be provided in the buffer chamber 440. The stirring ball moves with the flow of ink and the reciprocating movement of the carriage 200 in the main scanning direction, thereby stirring ink in the buffer chamber 440. Thus, sedimentation of some of ink components can be prevented, and ink characteristics are maintained to be uniform. The buffer chamber 440 directly communicates with the differential-pressure-valve-housing chamber 40*a* through a communication hole 442 provided in the wall of the buffer chamber 440, with no flow-paths interposed therebetween. Thus, the space ranging from the buffer chamber 440 to the liquid supply unit 50 is reduced, whereby the probability that ink gathered therein will form sediment can be reduced. In the differential-pressure-valve-housing chamber 40*a*, the differential pressure valve 40 adjusts the ink pressure in a region on the downstream side with respect to the differential-pressure-valve-housing chamber 40*a* to be lower than the ink pressure in a region on the upstream side so that the ink stored in the downstream region is subjected to a negative pressure. Thus, the backward flow of ink is prevented. The third flow path 450 communicates at the upstream end thereof with the differential-pressure-valve-housing chamber 40*a*, and at the downstream end thereof with the liquid supply unit 50.

At the completion of manufacture of the ink cartridge 1, referring to the conceptual diagram shown in FIG. 6, the range up to the tank chamber 370, as indicated by a dashed line ML1 representing the ink surface (the interface between air and ink) is filled with ink. When the ink in the ink cartridge 1 is consumed by the ink jet printer, the ink surface moves toward the downstream region, and air flows into the ink cartridge 1, from the upstream region through the air release hole 100. Accordingly, the ink surface is lowered in the vertical direction. When the ink is consumed more, the interface between air and ink reaches the sensor unit 30, as indicated by a dashed line ML2 shown in the conceptual diagram in FIG. 6.

The entry of air into the sensor unit 30 is detected as ink shortage by the remaining-liquid-amount sensor 31. Specifically, as described above, the remaining-liquid-amount sensor 31 outputs detection result signals having different signal waveforms (resonance frequencies) between the case where air is present in the sensor unit 30 (a case where bubbles are contained in the ink) and the case where air is absent in the sensor unit 30 (a case where ink fills the sensor unit 30). When ink shortage is detected in accordance with the corresponding detection result signal, the ink jet printer stops printing before the ink in the downstream region (including the buffer chamber 440 and so forth) of the ink cartridge 1 with respect to the sensor unit 30 is completely consumed, and notifies the user of ink shortage. This is because, if printing is performed after the ink is completely consumed, air flows into the printhead, causing so-called blank ejection that may lead to failure in the printhead.

Figure 15:
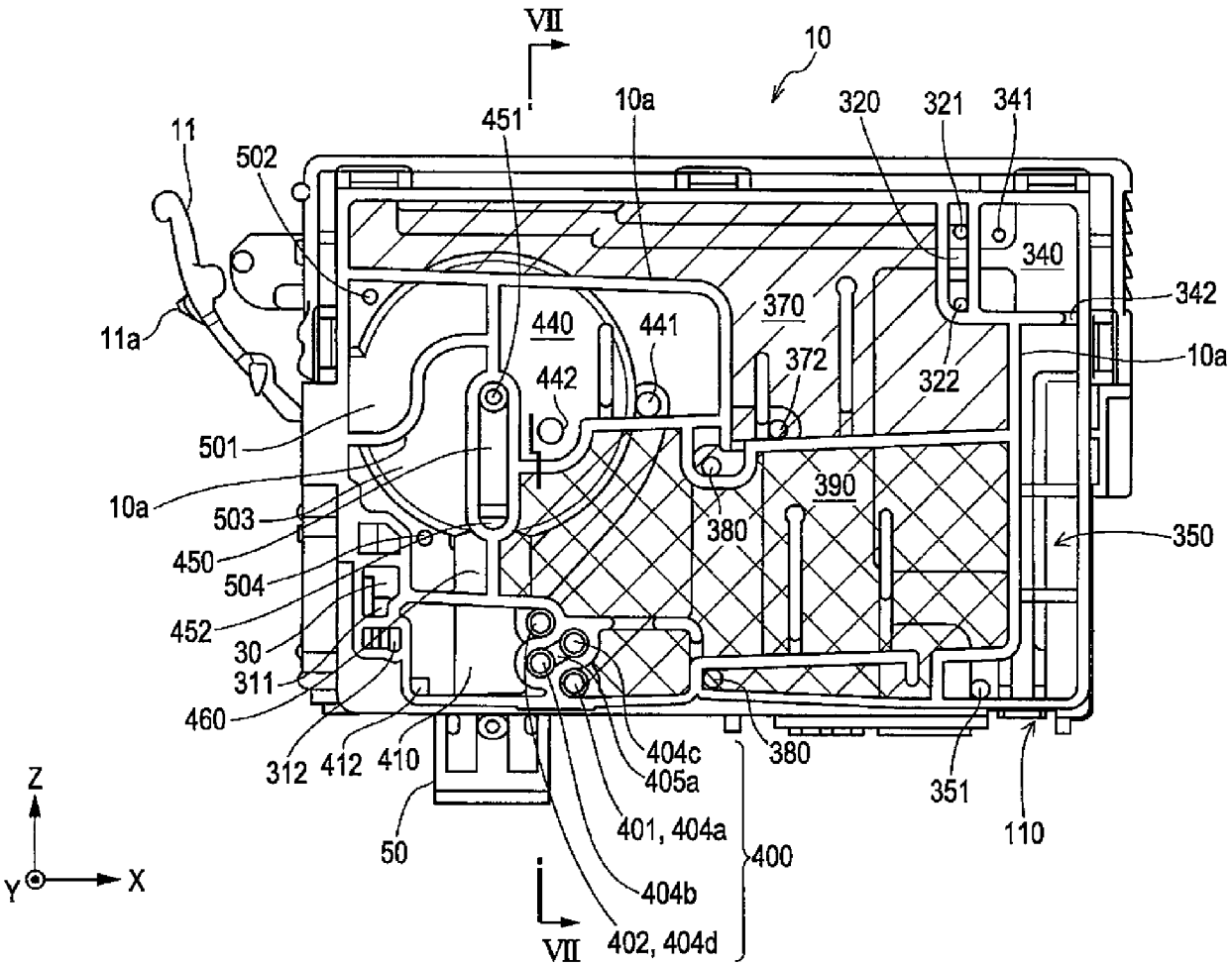
FIG. 15 is a front view of a cartridge body according to the embodiment.
Figure 16:
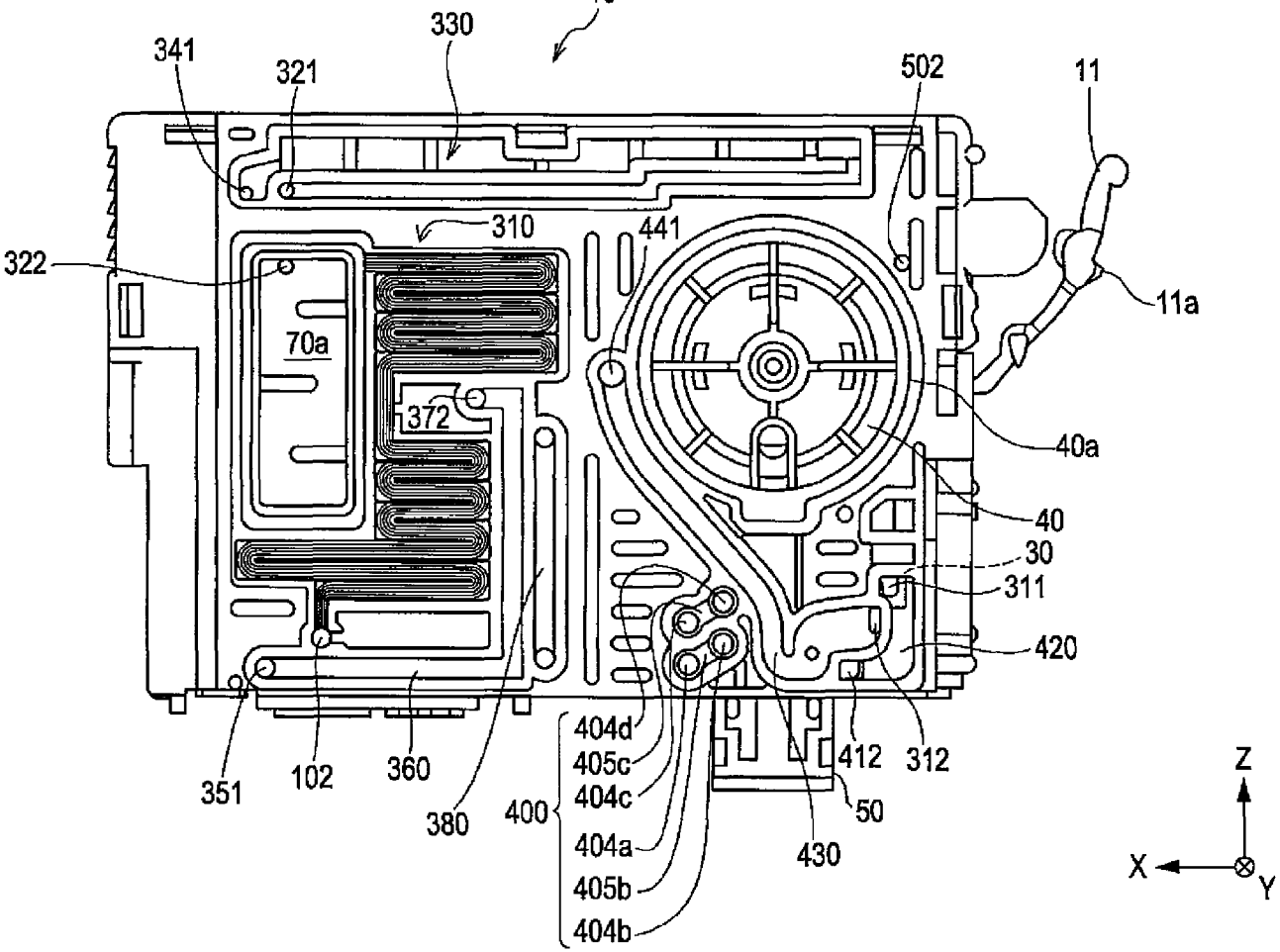
FIG. 16 is a back view of the cartridge body according to the embodiment.
Figure 17A:
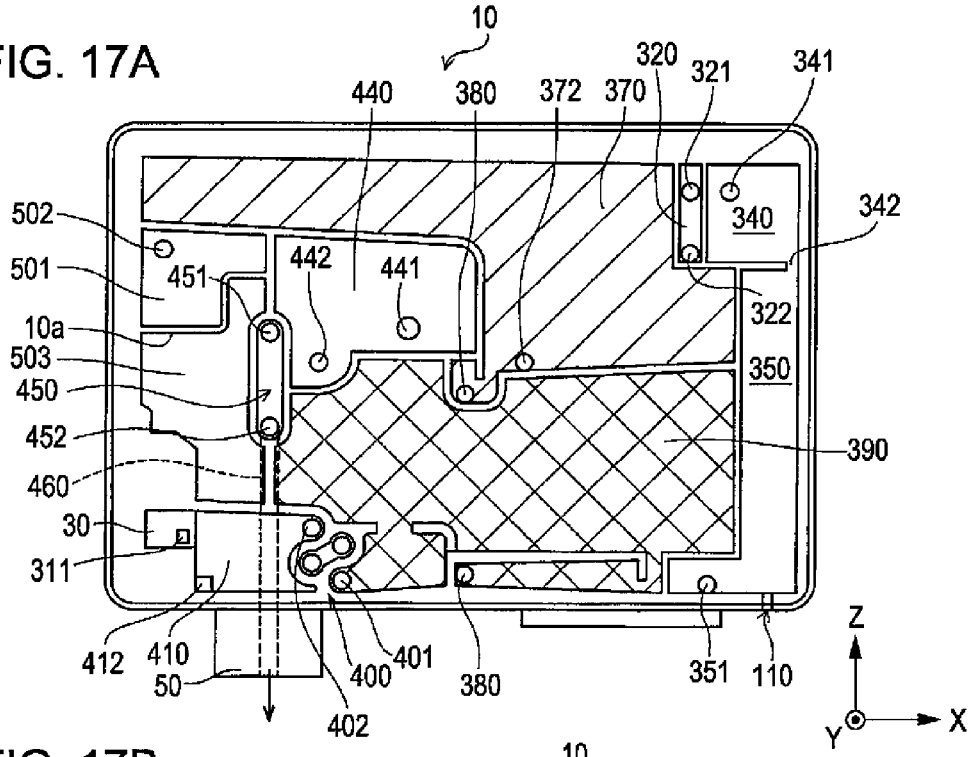
FIG. 17A is a simplified diagram corresponding to FIG. 15.
Figure 17B:
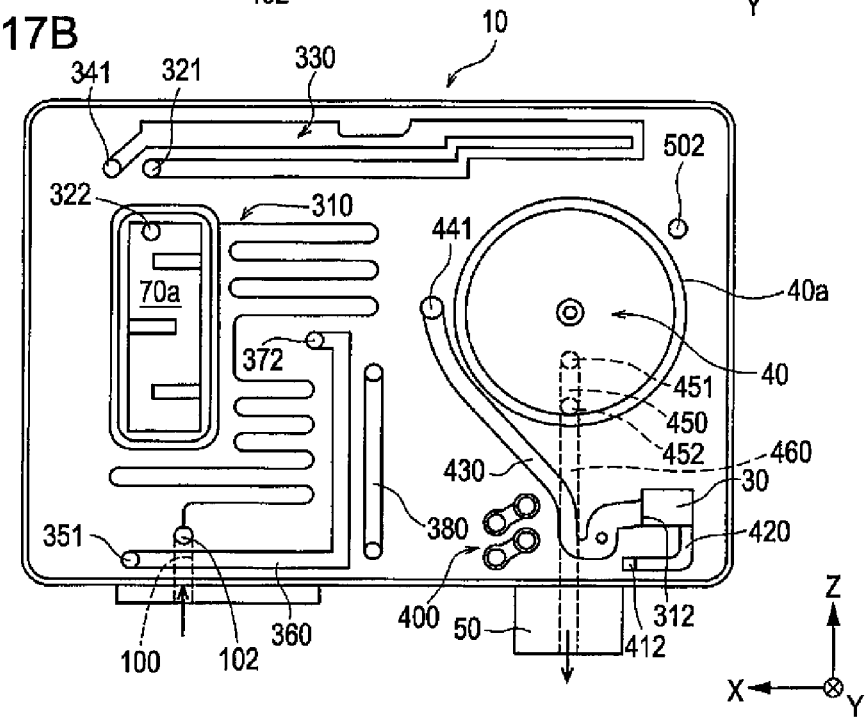
FIG. 17B is a simplified diagram corresponding to FIG. 16.

Based on the above description, the specific configurations of relevant elements provided inside the ink cartridge 1, in the range from the air release hole 100 to the liquid supply unit 50, will now be described with reference to FIGS. 15 to 17B. FIG. 15 is a front view of the cartridge body 10. FIG. 16 is a back view of the cartridge body 10. FIG. 17A is a simplified diagram corresponding to FIG. 15. FIG. 17B is a simplified diagram corresponding to FIG. 16.

The tank chamber 370 and the end chamber 390 included in the ink storage section are provided on the front side of the cartridge body 10. The tank chamber 370 and the end chamber 390 are shown in a single-hatched manner and a cross-hatched manner, respectively, in FIGS. 15 and 17A. The tank chamber 370 is provided between the air release hole 100 and the liquid supply unit 50 and immediately below a top panel of the cartridge body 10, i.e., at an upper region or the topmost region of the cartridge body 10. The end chamber 390 is provided between the air release hole 100 and the liquid supply unit 50 and immediately above a bottom panel of the cartridge body 10, i.e., at a lower region or the bottommost region of the cartridge body 10. Referring to FIGS. 16 and 17B, the inter-chamber communication path 380 is provided near the center on the back side of the cartridge body 10. The inter-chamber communication path 380 allows the tank chamber 370 and the end chamber 390 to communicate with each other, with the upstream end thereof connected to the tank chamber 370 and the downstream end thereof connected to the end chamber 390. Referring to FIGS. 15 and 17A, the upstream end of the inter-chamber communication path 380 is connected to the bottommost position of the tank chamber 370.

Referring to FIGS. 16 and 17B, the meandering path 310 and the air-liquid separation chamber 70*a* included in the air introduction section are provided on the back-right side of the cartridge body 10. A communication hole 102 allows the upstream end of the meandering path 310 and the air release hole 100 to communicate with each other. The downstream end of the meandering path 310 extends through a sidewall of the air-liquid separation chamber 70*a*, whereby the meandering path 310 communicates with the air-liquid separation chamber 70*a*.

The air chambers 320 to 360 included in the air introduction section shown in FIG. 6 will now be described in detail. Referring to FIGS. 15 and 17A, the air chambers 320, 340, and 350 are provided on the front side of the cartridge body 10. Referring to FIGS. 16 and 17B, the air chambers 330 and 360 are provided on the back side of the cartridge body 10. The air chambers 320 to 360 are connected in series in order of their reference numerals from the upstream side, thereby forming a single path. The air chambers 320 and 330 are provided immediately below the top panel of the cartridge body 10. The air chambers 340 and 350 are provided adjoining a right side panel of the cartridge body 10. A communication hole 322 allows the air-liquid separation chamber 70*a* and the air chamber 320 to communicate with each other. A communication hole 321 allows the air chambers 320 and 330 to communicate with each other. A communication hole 341 allows the air chambers 330 and 340 to communicate with each other. The air chambers 340 and 350 communicate with each other through a notch 342 in one of the ribs 10*a* provided therebetween. A communication hole 351 allows the air chambers 350 and 360 to communicate with each other. A communication hole 372 allows the air chamber 360 and the tank chamber 370 to communicate with each other. With the plurality of air chambers 320 to 360 provided three-dimensionally, the backward flow of ink from the tank chamber 370 toward the air-liquid separation chamber 70*a* can be suppressed.

Referring to FIGS. 15 and 17A, the vertical communication path 400 and the bubble separation chamber 410 included in the ink flow path section are provided on the front side of the cartridge body 10 and near the liquid supply unit 50. The vertical communication path 400 has the entrance 401 connected at the bottommost position of the end chamber 390, and the exit 402 connected at the topmost position of the bubble separation chamber 410. The vertical communication path 400 extends back and forth between the back end and the front end of the cartridge body 10 twice, and ultimately allows the end chamber 390 and the bubble separation chamber 410 to communicate with each other. Referring to FIGS. 15 to 17B, the sensor unit 30 is provided in a lower region on the left side of the cartridge body 10, as described above with reference to FIG. 4.

Referring to FIGS. 16 and 17B, the first flow path 420, which allows the bubble separation chamber 410 and the sensor unit 30 to communicate with each other, and the second flow path 430, which allows the sensor unit 30 and the buffer chamber 440 to communicate with each other, are provided on the back side of the cartridge body 10. The bubble separation chamber 410 has at the bottom thereof the communication hole 412, through which the bubble separation chamber 410 and the first flow path 420 communicate with each other. A communication hole 311 allows the first flow path 420 and the sensor unit 30 to communicate with each other. A communication hole 312 allows the sensor unit 30 and the second flow path 430 to communicate with each other. A communication hole 441 allows the second flow path 430 and the buffer chamber 440 to communicate with each other.

Referring to FIGS. 15 and 17A, the buffer chamber 440, the third flow path 450, and the fourth flow path 460 are provided on the front-left side of the cartridge body 10. The communication hole 441 allows the downstream end of the second flow path 430 and the buffer chamber 440 to communicate with each other. A communication hole 442 is provided at the bottom of the buffer chamber 440, thereby allowing the buffer chamber 440 and the differential-pressure-valve-housing chamber 40*a* to directly communicate with each other. A communication hole 451 allows the differential-pressure-valve-housing chamber 40*a* and the third flow path 450 to communicate with each other. A communication hole 452 allows the third flow path 450 and the fourth flow path 460, which is provided inside the liquid supply unit 50, to communicate with each other.

The upstream end of the inter-chamber communication path 380, the entrance 401, the communication hole 412, and the communication hole 442 are provided at the bottoms of the tank chamber 370, the end chamber 390, the bubble separation chamber 410, and the buffer chamber 440, respectively. This is to position the forgoing holes on the lower sides, in the vertical direction, of the tank chamber 370, the end chamber 390, the bubble separation chamber 410, and the buffer chamber 440, respectively, when the ink cartridge 1 is mounted on the carriage 200 with the bottom face 1*b* of the ink cartridge 1 vertically facing down. With such a configuration, even when the amount of remaining ink becomes smaller with ink consumption, ink is not trapped inside the foregoing chambers, avoiding waste of ink. Moreover, since bubbles move upward in the vertical direction, bubbles do not easily move toward the downstream side.

Referring to FIGS. 15 and 17A, unfilled chambers 501 and 503, in which no ink is supplied, are independent chambers provided off the path extending from the air release hole 100 to the liquid supply unit 50. Air communication holes 502 and 504, which allow outside-air passage therethrough, are provided at the backs of the unfilled chambers 501 and 503, respectively. When the ink cartridge 1 is packaged by reduced-pressure packaging, the unfilled chambers 501 and 503 serve as deaerating chambers in which negative pressure is accumulated. Thus, the ink cartridge 1 in the packaged state can maintain the pressure inside the cartridge body 10 below a specified value, whereby ink containing less dissolved air can be supplied.

As described above, since the ink cartridge 1 according to the embodiment includes the exit 402 having a cross section, intersecting the flow direction, whose area gently increases toward the bubble separation chamber 410, generation of bubbles in the bubble separation chamber 410 can be suppressed or prevented. Accordingly, the problematic flow of ink occurring when the ink runs on the surfaces of a plurality of bubbles can be suppressed or prevented. Further, the flow of ink into the sensor unit 30 caused by capillary action can be suppressed or prevented. Consequently, in a state where there still remains a small amount of ink in the ink cartridge 1 but the amount is insufficient to perform printing, misdetection indicating the presence of ink occurring because the remaining ink is drawn with air into the sensor unit 30 by capillary action can be suppressed or prevented.

Further, since the bubble separation chamber 410 is configured such that the cross section thereof becomes larger toward the sensor unit 30, the surface area of the ink film that is pushed out of the exit 402 can be made to. increase. This makes the ink film broken and disappear quickly. Thus, air and ink can be separated easily and quickly.

Furthermore, since the entrance 401 of the vertical communication path 400 widens upward in the vertical direction, even in a state where remaining ink is gathered at the bottom of the end chamber 390', air can solely be introduced into the bubble separation chamber 410. Specifically, since the entrance 401 is not closed by the remaining ink, providing a gap that allows air to flow therethrough, even if the pressure in the bubble separation chamber 410 is reduced with the consumption of ink, the ink is not drawn into the bubble separation chamber 410. Since ink, which is one of the constituents of bubbles, is not drawn into the vertical communication path 400, even if air flows inside the vertical communication path 400, no bubbles are formed.

Other Embodiments (1) The above embodiment concerns the case where the exit 402, shown in the schematic cross-sectional view in FIG. 12, has a shape that widens in an axisymmetrical manner, with two round corners. Alternatively, the exit 402 may have another shape, with one side thereof forming a round corner and the other side thereof extending in a straight line from the vertical communication path 400. Also with such a shape, the area of the cross section, intersecting the flow direction, of the exit 402 changes continuously. This also applies to the case of the cone-shaped exit 402 shown in FIG. 13.

(2) The above embodiment concerns the case where the ink storage section, corresponding to a liquid storage section, includes two chambers: the tank chamber 370 and the end chamber 390. Alternatively, one of the two chambers may only be included in the liquid storage section. In that case, the number of partitions provided in the ink cartridge 1 can be reduced.

(3) The above embodiment concerns the case where the bubble separation chamber 410 and the liquid storage section communicate with each other through the vertical communication path 400 rising in the vertical direction. Alternatively, a horizontal communication path that extends in the horizontal direction at the bottom of the ink cartridge 1 may be provided. Even in that case, if the horizontal communication path has such a shape that an entrance and an exit thereof each have a cross section, intersecting the flow direction, gently (continuously) becoming larger, entry of bubbles into the sensor unit 30 or generation of bubbles can be suppressed or prevented. Also in the case of the horizontal communication path, the exit thereof is desirably positioned at a higher level in the vertical direction than the entrance thereof. The vertical communication path 400 may either include a plurality of segments constructed in a rectangular back-and-forth shape as in the above embodiment, or include a single element in which a spiral groove is provided.

(4) The above embodiment concerns the case where the vertical communication path 400 has the entrance 401 and the exit 402, at which the vertical communication path 400 is connected to the end chamber 390 and the bubble separation chamber 410, respectively. Alternatively, the end chamber 390 and the bubble separation chamber 410 may include portions having shapes similar to the entrance 401 and the exit 402, respectively. As another alternative, connecting segments having shapes similar to the entrance 401 and the exit 402, respectively, may be provided as separate bodies from the vertical communication path 400, the end chamber 390, and the bubble separation chamber 410. In addition, in FIG.

13, the wall of the bubble separation chamber 410 adjoining the exit 402 is not tilted. Alternatively, the wall may be tilted toward the sensor unit 30. In FIG. 14, the bubble separation chamber 410 has no wall standing at the exit 402. Alternatively, a wall standing at the exit 402 may be provided by reducing the diameter of the exit 402.

(5) The above embodiment concerns the case of an ink jet printer serving as a liquid ejecting apparatus. Alternatively, any other liquid ejecting apparatus is acceptable that ejects or sprays liquid other than ink (a solution in which particles of a functional material are dispersed or a gel material) or a fluid other than liquid (a solid material that is ejectable as a fluid). Examples of such a liquid ejecting apparatus include a liquid ejecting apparatus that ejects a liquid material, such as an electrode material or a colorant, used in manufacturing a liquid crystal display, an electroluminescent (EL) display, a surface emission display, a color filter, or the like; a liquid ejecting apparatus that ejects a bio-organic substance used for manufacturing a biochip; a liquid ejecting apparatus, serving as a precision pipette, that ejects a liquid material as a sample; a liquid ejecting apparatus that ejects lubricant to a precision instrument, such as a clock or a camera, with pinpoint accuracy; a liquid ejecting apparatus that ejects toward a substrate transparent resinous liquid, such as ultraviolet-curable resin, for forming a micro-hemispherical lens (an optical lens) intended for optical communications devices and the like; a liquid ejecting apparatus that ejects etching liquid composed of acid, alkali, or the like for etching a substrate or the like; a fluid ejecting apparatus that ejects a gel material; and a power-jet-type recording apparatus that ejects a solid material such as powder toner.

The embodiments of the invention and variations thereof described above only help easy understanding of the invention and do not limit the invention. Various modifications and improvements can be made to the invention without departing from the scope and claims thereof, and various equivalents thereof are also included within the scope of the invention.

What is claimed is:

1. A liquid container mountable in a liquid ejecting apparatus, the liquid container comprising:

a liquid storage section that stores liquid;

an air communication section that allows the liquid storage section and an outside of the liquid container to communicate with each other;

a bubble separation unit that separates bubbles from the liquid;

a communication path that allows the bubble separation unit and the liquid storage section to communicate with each other and has at one end thereof an exit connected to the bubble separation unit and at the-other end thereof an entrance connected to the liquid storage section, the exit having a cross section whose area continuously increases toward the bubble separation unit;

a liquid supply unit through which the liquid is supplied to the liquid ejecting apparatus; and a detection unit that is connected to the liquid supply unit and the bubble separation unit and detects an amount of the liquid stored in the liquid container; and wherein the bubble separation unit is provided at an upstream side of the detection unit and the detection unit is provided at the upstream side of the liquid supply unit.

2. The liquid container according to claim 1, wherein the communication path has a tubular shape with a radius r1, wherein the exit has a round corner with a radius r2, and wherein a condition of $r2 \geqq r1 \times 2$ is satisfied.

3. The liquid container according to claim 1, wherein the exit has a cone shape with a cone angle of 75 degrees at a maximum at a tip of the cone shaped exit.

4. The liquid container according to claim 1, wherein the bubble separation unit has a cross section whose area continuously increases from the exit toward the detection unit.

5. The liquid container according to claim 4, wherein the bubble separation unit widens in a direction of the liquid container from the exit toward the detection unit, the direction intersecting a direction from the exit toward the detection unit.

6. The liquid container according to claim 1, wherein the entrance has a larger cross section than the communication path.

7. The liquid container according to claim 6, wherein the entrance has a cross section whose area increases toward the liquid storage section.

8. The liquid container according to claim 7, wherein the entrance has a sector shape that widens upward in a vertical direction, in a state where the liquid container is oriented so as to be mounted in the liquid ejecting apparatus upward in the vertical direction.

9. The liquid container according to claim 1, wherein the bubble separation unit has a larger capacity than the communication path.

* * * * *